US010124587B2

(12) United States Patent
Kakiuchi

(10) Patent No.: US 10,124,587 B2
(45) Date of Patent: Nov. 13, 2018

(54) LIQUID DISCHARGING APPARATUS

(71) Applicant: Brother Kogyo Kabushiki Kaisha, Nagoya-shi, Aichi-ken (JP)

(72) Inventor: Toru Kakiuchi, Chita-gun (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/674,678

(22) Filed: Aug. 11, 2017

(65) Prior Publication Data

US 2018/0050541 A1 Feb. 22, 2018

Related U.S. Application Data

(63) Continuation of application No. 15/279,966, filed on Sep. 29, 2016, now Pat. No. 9,764,552.

(30) Foreign Application Priority Data

Oct. 1, 2015 (JP) ..... 2015-195550

(51) Int. Cl.
*B41J 2/14* (2006.01)

(52) U.S. Cl.
CPC ..... *B41J 2/14233* (2013.01); *B41J 2/14201* (2013.01); *B41J 2/14274* (2013.01); *B41J 2002/14241* (2013.01); *B41J 2002/14266* (2013.01); *B41J 2002/14491* (2013.01)

(58) Field of Classification Search
CPC ..... B41J 2/14201; B41J 2/14209; B41J 2/14233; B41J 2/14274; B41J 2002/14217; B41J 2002/14225
See application file for complete search history.

(56) References Cited

U.S. PATENT DOCUMENTS 6,471,342 B1 10/2002 Horio et al.
7,533,972 B2 5/2009 Mita
8,833,910 B2 * 9/2014 Takahashi ..... B41J 2/14233 347/70
2007/0285472 A1 12/2007 Hara et al.

FOREIGN PATENT DOCUMENTS

JP H07-60958 A 3/1995
JP 2002-001946 A 1/2002
JP 3267937 B2 3/2002
JP 2007-237599 A 9/2007

* cited by examiner

*Primary Examiner* — Juanita D Jackson
(74) *Attorney, Agent, or Firm* — Banner & Witcoff, Ltd.

(57) ABSTRACT

There is provided a liquid discharging apparatus including: a substrate formed with a first pressure chamber and two second pressure chambers; a vibration film; a first piezoelectric element; two second piezoelectric elements; a first wire connected to the first piezoelectric element; two second wires connected to the two second piezoelectric elements, respectively; and three contact sections to which the first wire and the two second wires are connected, respectively. The first wire passes between the two second piezoelectric elements and extends toward one of the three contact sections corresponding thereto; and length in the first direction of second active portions in second piezoelectric portions of the two second piezoelectric elements, is shorter than that of a first active portion in a first piezoelectric portion of the first piezoelectric element; and length in the second direction of the second active portion is longer than that of the first active portion.

12 Claims, 7 Drawing Sheets

LIQUID DISCHARGING APPARATUS

CROSS REFERENCE TO RELATED APPLICATION

The present application is a continuation of U.S. patent application Ser. No. 15/279,966 filed Sep. 29, 2016, now U.S. Pat. No. 9,764,552, which claims priority from Japanese Patent Application No. 2015-195550 filed on Oct. 1, 2015 the disclosures of which are incorporated herein by reference in their entirety.

BACKGROUND

Field of the Invention

The present invention relates to a liquid discharging apparatus.

Background Art

Conventionally, as a liquid discharging apparatus, there is known an ink-jet head which discharges an ink from a nozzle toward a recording medium as an object on which a recording is to be performed. This ink-jet head is provided with a head body formed with a plurality of nozzles and a plurality of pressure chambers communicating with the plurality of nozzles, respectively; and a plurality of piezoelectric elements (piezoelectric actuator) corresponding to the plurality of pressure chambers, respectively.

The plurality of pressure chambers are aligned to form a plurality of rows of pressure chambers, and the plurality of piezoelectric elements are also aligned to form a plurality of rows of piezoelectric elements corresponding to the plurality of rows of pressure chambers. One wire is drawn from each of the piezoelectric elements to one side in an arrangement direction of the rows of pressure chambers in which the rows of the pressure chambers are arranged side-by-side (direction orthogonal to the alignment direction of the pressure chambers) and is connected to one of signal input terminals. In a certain row of the piezoelectric elements, which is included in the plurality of rows of piezoelectric elements and arranged at an end on the wire-drawn side (on a side at which the signal input terminals are arranged), each of wires, drawn from piezoelectric elements belonging to another or other row(s) of piezoelectric elements and different from the certain row of piezoelectric elements, passes between two adjacent piezoelectric elements belonging to the certain row and adjacent in the alignment direction.

In a case that the above-described configuration is adopted, each of the wires is required to be arranged between two piezoelectric elements so as to secure a distance to some extent with respect to electrodes of the piezoelectric elements, while maintaining the insulation property among the respective wires. Further, in a case that the wires are arranged such that each of the wires is arranged while overlapping with a portion or part of the piezoelectric element(s), the overlapping wire inhibits or hinders the deformation of the piezoelectric element. Furthermore, in a case that the shape and/or size of the piezoelectric elements are made to be uniform and that the extent by which the wire overlaps with each of the piezoelectric elements is different among the piezoelectric elements, the characteristics are varied among the piezoelectric elements such that any uniform discharging characteristic cannot be obtained among the nozzles.

On the other hand, the alignment pitch (arrangement pitch) at which the nozzles are arranged to form a nozzle row or rows is required to be made small from the viewpoint of realizing a small-sized head and of high-density arrangement of nozzles. However, if the alignment pitch of the nozzles is made small, the alignment pitch of the pressure chambers is also made small corresponding thereto, which in turn makes it difficult to adopt the configuration wherein two adjacent piezoelectric elements belonging to a certain piezoelectric element row are capable of allowing a wire of a piezoelectric element, belonging to another piezoelectric element row different from the certain piezoelectric element row, to pass between the two adjacent piezoelectric elements.

An object of the present teaching is to provide a liquid discharging apparatus in which the alignment pitch of the pressure chambers (piezoelectric elements) can be made small while allowing a wire of a piezoelectric element belonging to a certain piezoelectric element row to pass between other two adjacent piezoelectric elements belonging to another piezoelectric element row different from the certain piezoelectric element row.

SUMMARY

There is provided a liquid discharging apparatus configured to discharge a liquid, including:

a substrate in which a first nozzle, a first pressure chamber communicating with the first nozzle, two second nozzles arranged side by side in a first direction, and two second pressure chambers communicating with the two second nozzles respectively, arranged side by side in the first direction, and arranged on one side, in a second direction crossing the first direction, relative to the first pressure chamber, are defined;

a vibration film which is arranged to cover the first pressure chamber and the two second pressure chambers;

a first piezoelectric element which is arranged on the vibration film corresponding to the first pressure chamber and which includes a first piezoelectric portion overlapping with the first pressure chamber, and a first electrode pair constructed of two electrodes sandwiching the first piezoelectric portion in a third direction orthogonal to the first and second directions;

two second piezoelectric elements which are arranged side by side on the vibration film corresponding to the two second pressure chambers, respectively, and each of which includes a second piezoelectric portion overlapping with one of the two second pressure chambers, and a second electrode pair constructed of two electrodes sandwiching the second piezoelectric portion in the third direction;

a first wire which is connected to the first piezoelectric element, and which extends toward the one side in the second direction;

two second wires which are connected to the two second piezoelectric elements, respectively, and which extend toward the one side in the second direction; and three contact sections which are arranged on the one side in the second direction relative to the two second piezoelectric elements, and to which the first wire and the two second wires are connected, respectively, wherein the first wire passes between the two second piezoelectric elements and extends toward a contact section, among the three contact sections, corresponding thereto; and length in the first direction of a second active portion, which is included in the second piezoelectric portion of each of the two second piezoelectric elements and which is sandwiched between the second electrode pair, is shorter than length in the first direction of a first active portion which is included in the first piezoelectric portion of the first piezoelectric element and which is sandwiched between the first electrode pair; and length in the second direction of the second active portion is longer than length in the second direction of the first active portion.

Each of the first wire connected to the first piezoelectric element and the two second wires connected to the two second piezoelectric elements respectively extends toward the one side in the second direction to be connected to one of the three contact sections. Further, the first wire from the first piezoelectric element passes between the two second piezoelectric elements which are located closer to the contact sections than the first piezoelectric element.

In addition to this configuration, in the present teaching, the length in the first direction of the second active portion, which is included in the second piezoelectric portion of each of the two second piezoelectric elements (a portion which is deformed when voltage is applied to the second electrode pair), is shorter than the length in the first direction of the first active portion which is included in the first piezoelectric portion of the first piezoelectric element. Owing to this configuration, the spacing distance in the first direction, between the second active portions of the two adjacent second piezoelectric portions, is widened and makes it easier to arrange the first wire between the two second piezoelectric elements. On the other hand, the length in the second direction of the second active portion is longer than the length in the second direction of the first active portion. With this, any change in the characteristic (reduction in the displacement amount) of the second active portion due to the shortening of the length in the first direction is supplemented (compensated) and any difference in the characteristic between the first and second active portions can be made small.

DESCRIPTION OF THE EMBODIMENTS

Figure 1:
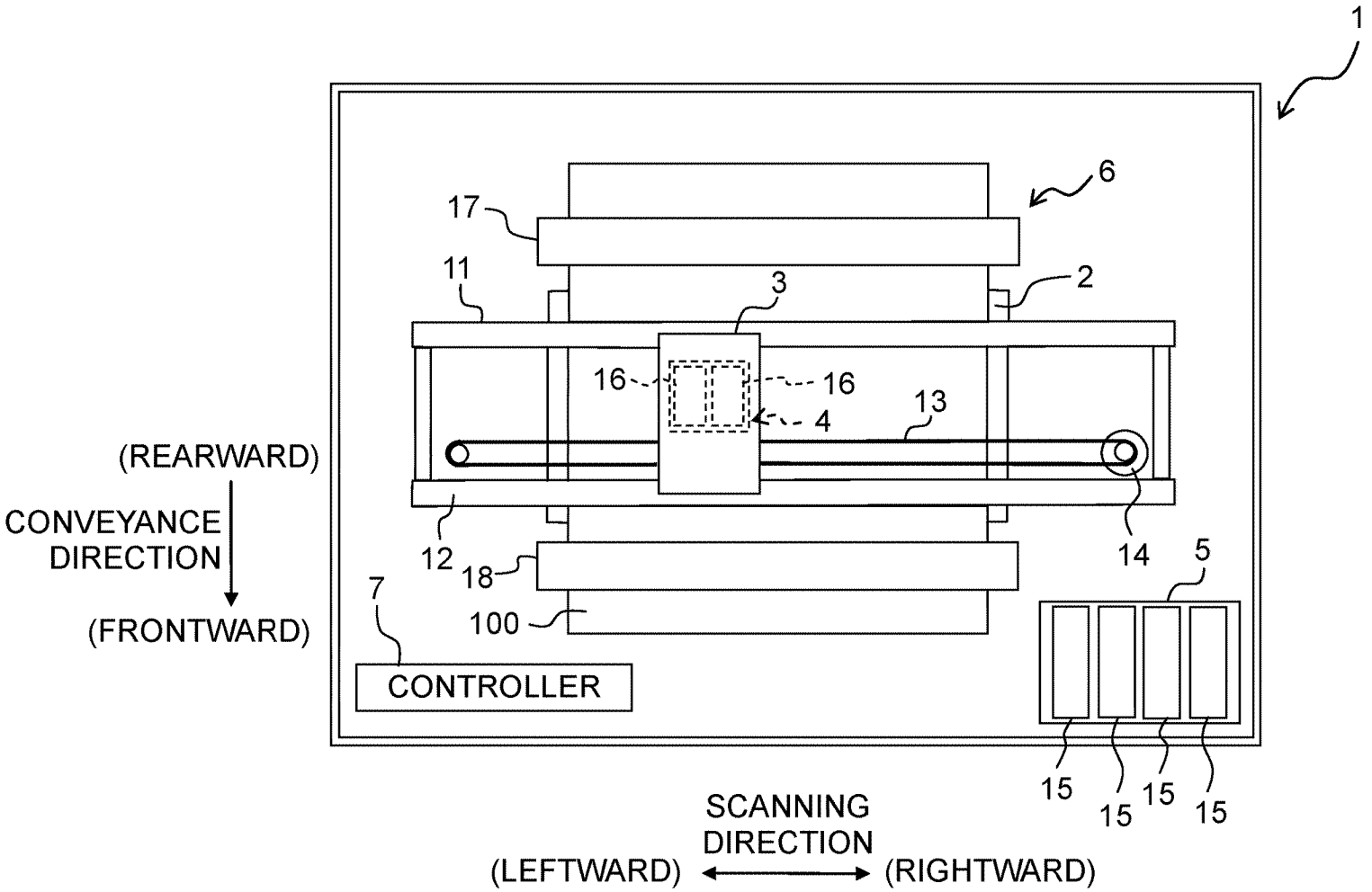
FIG. 1 is a schematic plane view of a printer according to an embodiment of the present teaching.

Next, an embodiment of the present teaching will be described. The respective directions of front, rear, left, right as depicted in FIG. 1 are defined as "front (frontward)", "rear (rearward)", "left (leftward)" and "right (rightward)" of the printer. Further, the fore side (front side) of the sheet surface of FIG. 1 is defined as "up (upward), and the far side (the other side) of the sheet surface of FIG. 1 is defined as "down (downward)".

<Schematic Configuration of Printer>

As depicted in FIG. 1, an ink-jet printer 1 is provided with a platen 2, a carriage 3, an ink-jet head 4, a cartridge holder 5, a conveyance mechanism 6, a controller 7, etc.

On the upper surface of the platen 2, a recording paper (recording paper sheet) 100 as a recording medium is placed. The recording paper 100 faces or is arranged opposite to the ink-jet head 4 (to be described later on) with a spacing distance suitable for image formation. The carriage 3 is supported by two guide rails 10, 11 and is thereby configured to be reciprocable in the left and right directions (hereinafter referred to also as a "scanning direction"). An endless belt 13 is connected to the carriage 3. When the endless belt 13 is driven by a carriage drive motor 14, the carriage 3 is thereby moved in the scanning direction together with the endless belt 13.

The ink-jet head 4 is attached to the carriage 3 and moves in the scanning direction together with the carriage 3. The ink-jet head 4 is connected, for example by non-illustrated tubes, to a cartridge holder 5 on which ink cartridges 15 for four colors (black, yellow, cyan and magenta) are installed. The ink-jet head 4 is provided with two head units 16 (corresponding to a "liquid discharging apparatus" of the present teaching) arranged side by side in the scanning direction.

Each of the head units 16 has a plurality of nozzles 24 (see FIGS. 2 to 5) which are formed in the lower surface (the surface on the far side of the sheet surface of FIG. 1) of each of the head units 16, and each of the head units 16 discharges inks of two colors. Specifically, one of the two head units 16 is configured to discharge two color inks that are the black and yellow inks, and the other of the two head units 16 is configured to discharge two color inks that are the cyan and magenta inks. With this, the ink-jet head 4 is capable of discharging the four color inks. The details configuration of the head units 16 will be described later on.

On the cartridge holder 5, the ink cartridges 15 for the inks of four colors (black, yellow, cyan and magenta) are detachably installed. The four color inks in the four ink cartridges 15, respectively, are supplied to the ink-jet head 4 via the tubes. The ink-jet head 4 causes the ink(s) to be discharged from the nozzles 24, formed in the lower surface of the ink-jet head 4, toward the recording paper 100 placed on the platen 2, while the ink-jet head 4 is moving in the scanning direction together with the carriage 3.

The conveyance mechanism 6 has two conveyance rollers 17, 18 arranged to sandwich the platen 2 therebetween in the front and rear directions. The two conveyance rollers 17 and 18 are driven while being synchronized to each other by a conveyance motor (not depicted in the drawings) to thereby convey the recording paper 100 placed on the platen 2 in the front direction (hereinafter referred to also as a "conveyance direction").

The controller 7 includes a Central Processing Unit (CPU), a Read Only Memory (ROM), a Random Access Memory (RAM), an Application Specific Integrated Circuit (ASIC) including various control circuits, etc. The controller 7 executes programs stored in the ROM by the CPU to thereby cause the ASIC to perform various processes such as printing onto the recording paper 100, etc. For example, in the printing process, based on a print command input from an external device such as a Personal Computer (PC), the controller 7 controls the ink-jet head 4, the carriage drive motor 14, the conveyance motor of the conveyance mechanism 6, etc., so as to print an image, etc. on the recording paper 100. More specifically, the controller 7 alternately performs an ink discharging operation for causing the ink(s) to be discharged while moving the ink-jet head 4 in the scanning direction together with the carriage 3, and a conveyance operation for causing the conveyance rollers 17 and 18 to convey the recording paper 100 by a predetermined amount in the conveyance direction.

<Detailed Configuration of Head Unit of Ink-Jet Head>

Next, the detailed configuration of the head units 16 of the ink-jet head 4 will be explained. Since the two head units 16 have a same configuration, one of the head units 16 which discharges the black and yellow inks will be explained representatively also for the other of the head units 16 discharging the cyan and magenta inks.

Figure 2:
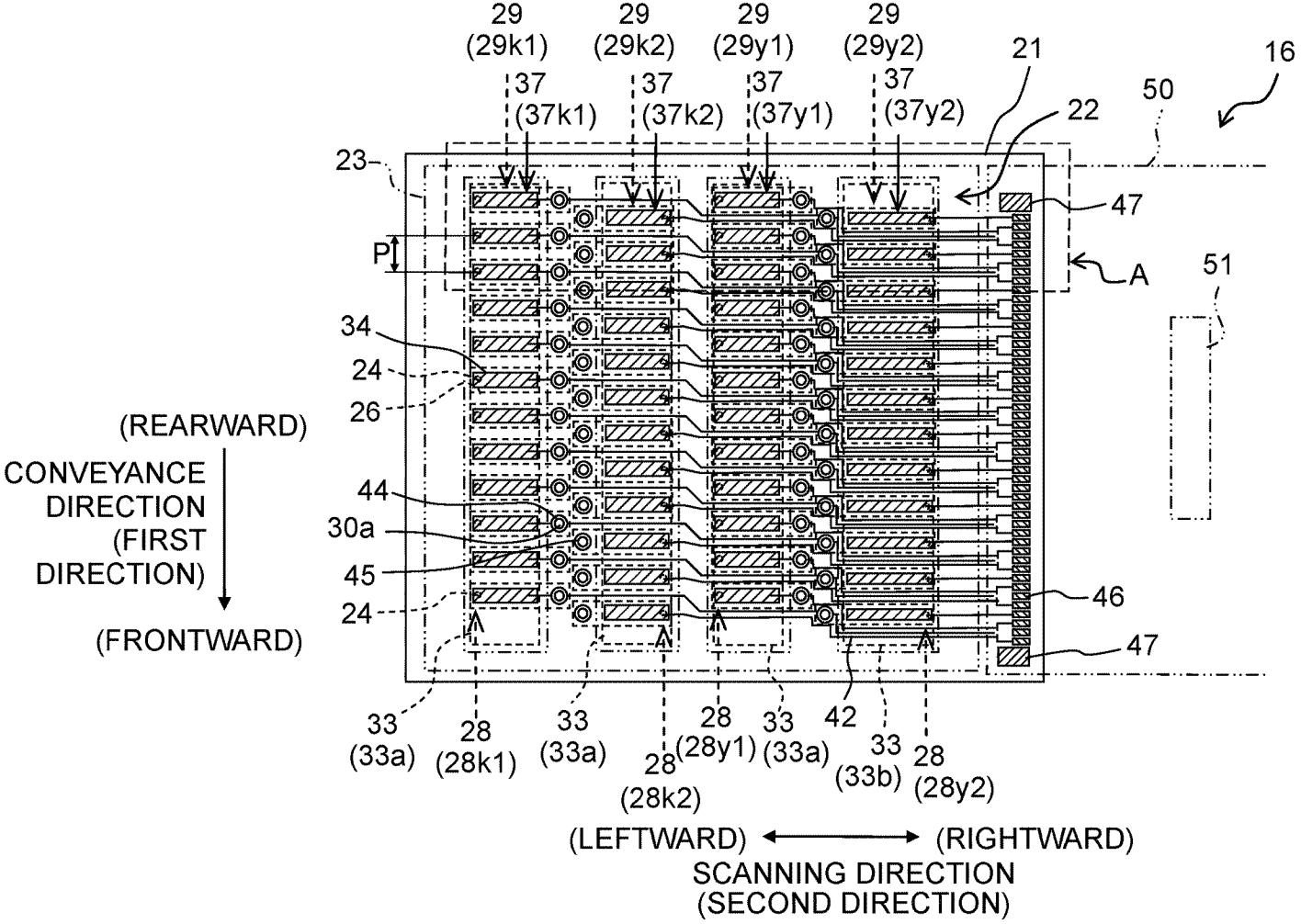
FIG. 2 is a top view of a head unit of an ink-jet head.
Figure 3:
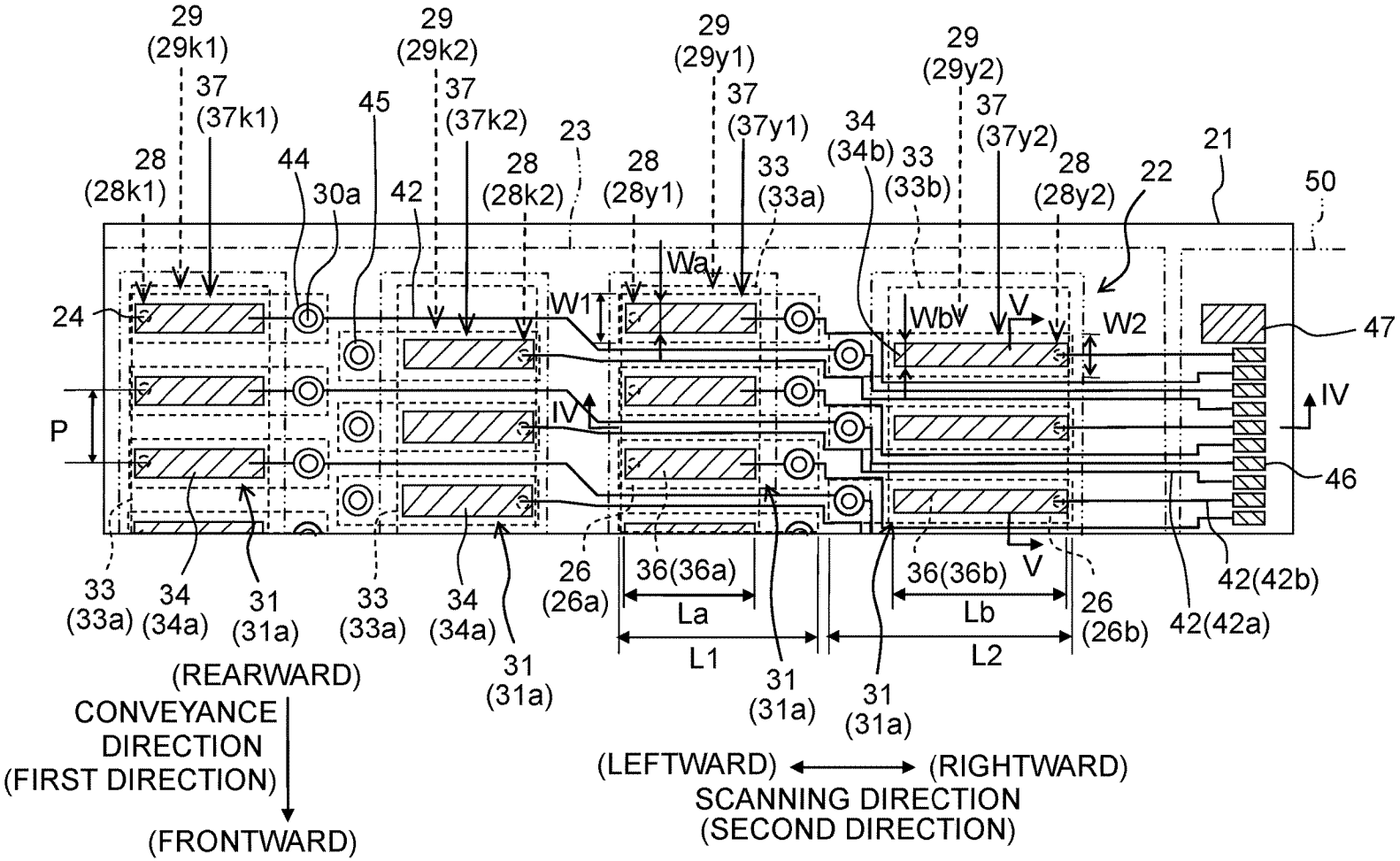
FIG. 3 is an enlarged view of an A-portion in FIG. 2.
Figure 4:
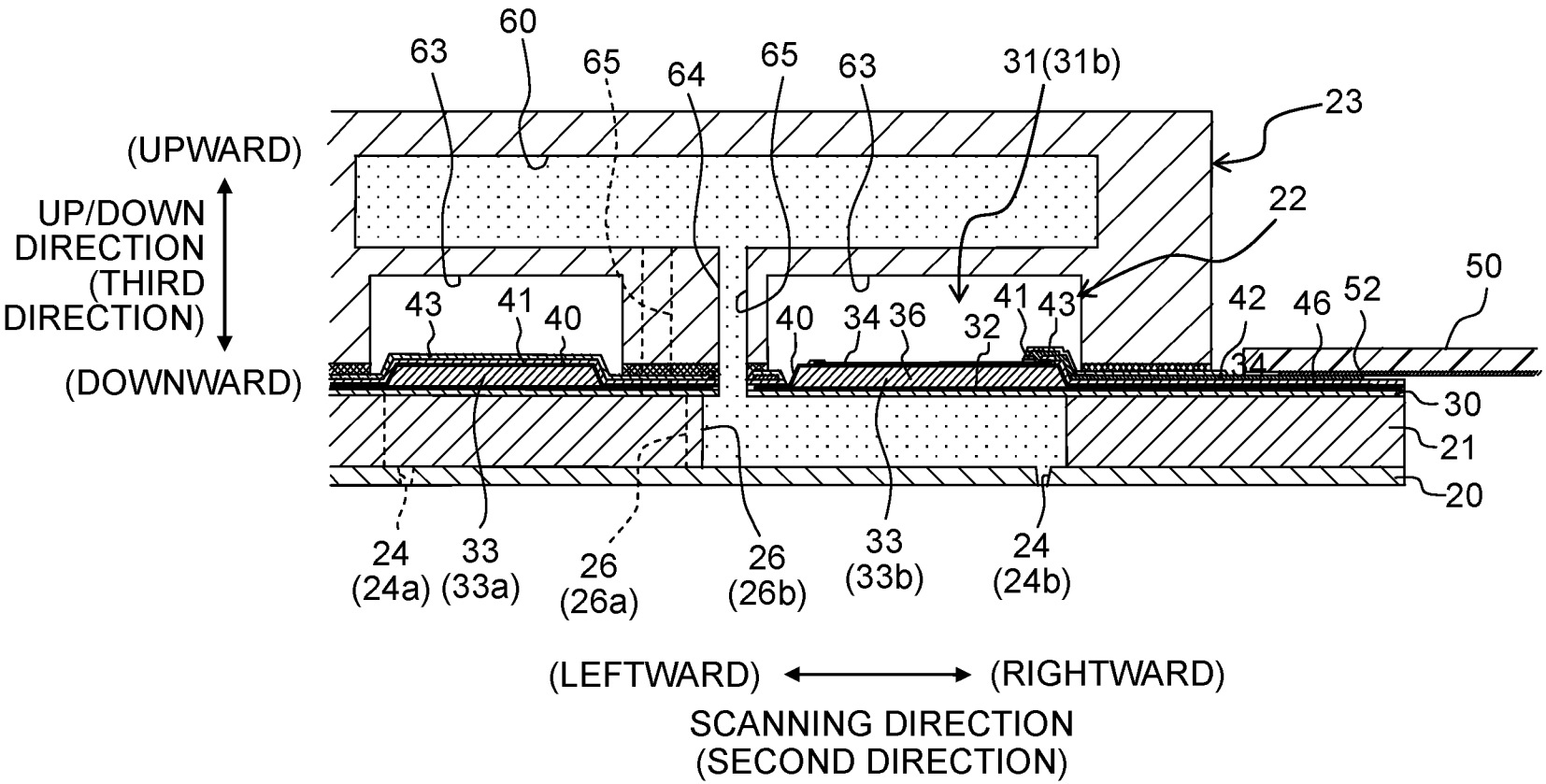
FIG. 4 is a cross-sectional view taken along an IV-IV line in FIG. 3.
Figure 5:
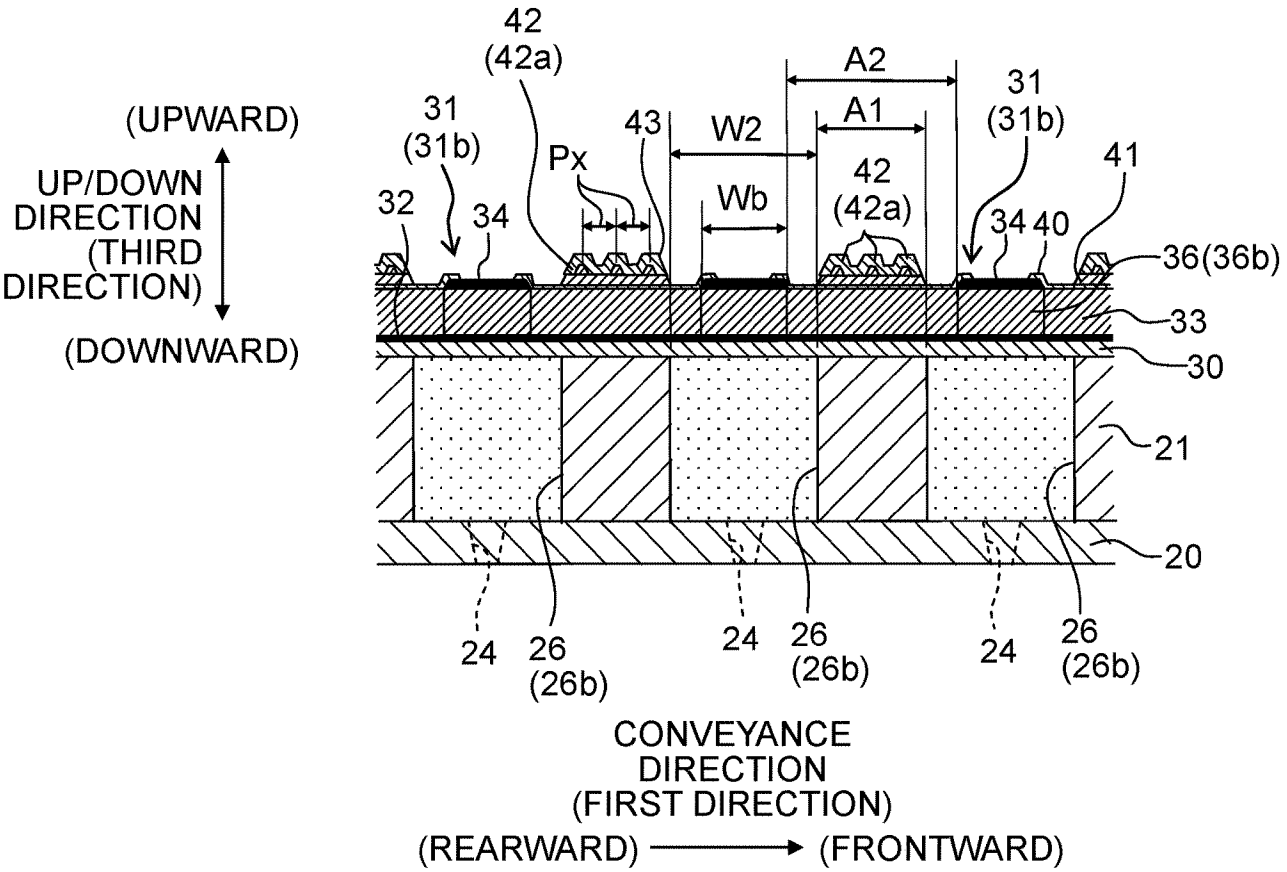
FIG. 5 is a cross-sectional view taken along a V-V line in FIG. 3.

As depicted in FIGS. 2 to 5, the head unit 16 includes a nozzle plate 20, a channel substrate 21, a piezoelectric actuator 22, a reservoir forming member 23, etc. Note that in FIGS. 2 and 3, regarding the reservoir forming member 23 located above the channel substrate 21 as depicted in FIG. 4, only its outer shape is depicted by a two-dot chain line for simplification of the drawings. Further in FIGS. 2 and 3, a protective film 40, an insulating film 41 and a wire protecting film 43 which are depicted in FIGS. 4 and 5 are omitted so that the configuration of a main portion of the piezoelectric actuator 22 can be easily understood.

<Nozzle Plate>

The nozzle plate 20 is a plate formed of, for example, silicon, etc. The plurality of nozzles 24 are formed in the nozzle plate 20. The lower surface of the nozzle plate 20 is an ink discharge surface from which an ink is discharged. More specifically, as depicted in FIG. 2, the nozzles 24 are aligned in the conveyance direction ("first direction" in the present teaching) to form four nozzle rows 28 arranged side by side in the scanning direction ("second direction" in the present teaching) orthogonal to the conveyance direction. Among the four nozzle rows 28, two nozzle rows 28 on the left side (nozzle rows 28*k*1, 28*k*2) discharge the black ink, and two nozzle rows 28 on the right side (nozzle rows 28*y*1, 28*y*2) discharge the yellow ink. Note that in the following explanation, among components or parts constructing the ink-jet head 4, those corresponding to the configurations regarding the black and the yellow inks are added, at the end of the reference numeral thereof, with suffixes indicating the colors such as "k" (indicating black) and "y" (indicating yellow), respectively.

In each of the nozzle rows 28, the plurality of nozzles 24 are aligned in the conveyance direction at a nozzle alignment (arrangement) pitch "P". Further, between two nozzle rows 28 discharging a same color ink, positions of the nozzles 24 in one of the two nozzle rows 28 and positions of the nozzles 24 in the other one of the two nozzle rows 28 are deviated or shifted from each other, in the conveyance direction, by a half (P/2) of the nozzle alignment pitch P in each nozzle row. Namely, the plurality of nozzles 24 discharging the same color ink are aligned in a staggered manner and at an equal interval in the conveyance direction.

<Channel Substrate>

The channel substrate 21 is a substrate formed of a silicon single-crystal. The channel substrate 21 is formed with a plurality of through holes. In each of the through holes, a lower opening thereof is covered by the nozzle plate 20, and an upper opening thereof is covered by a vibration film 30 (to be described later on), thereby forming a pressure chamber 26, as depicted in FIG. 4. A plurality of pieces of the pressure chamber 26 are aligned in rows, along the nozzle rows 28, respectively, in the conveyance direction, thus forming two pressure chamber rows 29 for each of the two color inks. Regarding these two pressure chamber rows 29, the plurality of pressure chambers 26 are aligned in a staggered manner and at an equal interval in the conveyance direction. In one head unit 16, the total of four pressure chamber rows 29*k*1, 29*k*2, 29*y*1 and 29*y*2 are constructed.

Each of the respective pressure chambers 26 is configured such that regarding one color ink, an outer-side portion in the scanning direction of the through hole is communicated with one of the nozzles 24. Specifically, as depicted in FIG. 3, regarding two pressure chamber rows 29 for one color ink, in a pressure chamber row 29 arranged on the left side, a left end portion of each of the pressure chambers 26 is overlapped with one of the nozzles 24; and in a pressure chamber row 29 arranged on the right side, a right end portion of each of the pressure chambers 26 is overlapped with one of the nozzles 24.

Each of the pressure chambers 26 has a length in the scanning direction which is longer than a width thereof in the conveyance direction, and has a rectangular planar shape. Note that among the four pressure chamber rows 29, pressure chambers 26 (26*b*) constructing the pressure chamber row 29*y*2 located on the right (rightmost) end have a shape which is different from the shape of pressure chambers 26 (26*a*) constructing the remaining pressure chamber rows 29*k*1, 29*k*2 and 29*y*1.

Specifically, a width W2 in the conveyance direction of the pressure chambers 26*b* on the right end is smaller than a width W1 in the conveyance direction of the remaining pressure chambers 26*a*. On the other hand, a length L2 in the scanning direction of the pressure chambers 26*b* on the right end is longer than a length L1 in the scanning direction of the remaining pressure chambers 26*a*. Note that the alignment pitch of the pressure chambers 26 in the conveyance direction is all the same with the alignment pitch P for the nozzles 24. Accordingly, in the pressure chamber row 29*y*2 in the right end, a width A1 of a space or gap (see FIG. 5) between two pressure chambers 26*b* adjacent in the conveyance direction is wider than that in the remaining pressure chamber rows 29.

Note that in the following explanation, the pressure chamber 26*a* having a greater width is referred to as a "first pressure chamber 26*a*", and the pressure chamber 26*b* having a smaller width is referred to as a "second pressure chamber 26*b*"; and that a nozzle 24*a* communicating with the first pressure chamber 26*a* is referred to as a "first nozzle 24*a*", and a nozzle 24*b* communicating with the second pressure chamber 26*b* is referred to as a "second nozzle 24*b*".

A vibration film 30 covering the plurality of pressure chambers 26 is formed in the upper surface of the channel substrate 21. The vibration film 30 is a thin film formed, for example, by oxidizing or nitrifying a surface of the silicon substrate. Alternatively, the vibration film 30 may be a silicon oxide film or a silicon nitride film produced by the sputtering method, the CVD method, etc. The vibration film 30 is formed with ink supply holes 30*a* which penetrate through the vibration film 30 and each of which corresponds to one of the pressure chambers 26. As depicted in FIG. 3, each of the ink supply holes 30*a* faces or is opposite to an inner-side end portion in the scanning direction (an end portion on the side opposite to the nozzle 24) of one of the pressure chambers 26.

The ink is supplied from a reservoir 60 (to be described later on) inside the reservoir forming member 23 to each of the pressure chambers 26 via the ink supply hole 30*a*. Further, when discharge energy is imparted to the ink inside a certain pressure chamber 26 by the piezoelectric actuator 22 (to be described next), an ink droplet of the ink is discharged from a nozzle 24 communicating with the certain pressure chamber 26.

<Piezoelectric Actuator>

The piezoelectric actuator 22 includes the vibration film 30 and a plurality of piezoelectric elements 31 formed on the vibration film 30. The plurality of piezoelectric elements 31 are formed corresponding to the pressure chambers 26, respectively, and face (are opposite to) the pressure chambers 26 with the vibration film 30 sandwiched therebetweeen. Each of the piezoelectric elements 31 imparts discharge energy for causing the ink inside one of the pressure chambers 26 to be discharged from one of the nozzles 24. Note that a semiconductor process (film formation by the CVD method, the sputtering method, etc., and patterning by the photolithographic method) is mainly used to produce the piezoelectric actuator 22, thereby forming an electrode film, a piezoelectric film, a protective film, etc., successively on the vibration film 30.

Each of the piezoelectric elements 31 includes a common electrode 32, a piezoelectric body 33 and an individual electrode 34. Each of the piezoelectric elements 31 is a power source of the piezoelectric actuator 22, and cooperates with the vibration film 30 to thereby change the volume of one of the pressure chambers 26. As depicted in FIG. 4, the common electrode 32 is formed substantially on the entire surface of the vibration film 30 so as to include regions, of the vibration film 30, which face the plurality of pressure chambers 26. The common electrode 32 is formed, for example, of platinum (Pt).

Four band-shaped piezoelectric bodies 33 are formed on the common electrode 32, corresponding to the pressure chamber rows, respectively. As depicted in FIG. 2, each of the piezoelectric bodies 33 is elongated in the conveyance direction, and with respect to the conveyance direction, each piezoelectric body 33 is arranged to straddle pressure chambers 26 which form a pressure chamber row corresponding thereto. Each piezoelectric body 33 is made, for example, of a piezoelectric material of which main component is lead zirconate titanate (PZT) that is a mixed crystal of lead titanate and lead zirconate. Alternatively, each piezoelectric body 33 may be made of a lead-free piezoelectric material that does not contain any lead. Note that among the four piezoelectric bodies 33, a piezoelectric body 33*b* on the right (rightmost) end has a width (length in the scanning direction) which is greater than those of three piezoelectric bodies 33*a* located on the left side.

A plurality of pieces of the individual electrode 34 are formed on the upper surface of each of the piezoelectric bodies 33 such that the individual electrodes 34 individually face the pressure chambers 26, respectively. The individual electrodes 34 are formed, for example, of iridium (Ir). Each of the individual electrodes 34 has a rectangular shape in a plan view (rectangular planar shape) which is smaller to some extent than one of the pressure chambers 26; each of the individual electrodes 34 is arranged so as to overlap with a central portion of one of the pressure chambers 26 corresponding thereto. Note that, as described above, the second pressure chambers 26*b* on the right end are more elongated in the scanning direction than the first pressure chambers 26*a*. Corresponding to this, individual electrodes 34*b* on the right (rightmost) end also have a width Wb in the conveyance direction which is smaller than a width Wa in the conveyance direction of the individual electrodes 34*a*; and the individual electrodes 34*b* on the right end have a length Lb in the scanning direction which is longer than a length La in the scanning direction of the individual electrodes 34*a*.

In the configuration as described above, with respect to each of the pressure chambers 26, a piezoelectric element 31 is composed of a portion of the piezoelectric body 33 facing the pressure chamber 26, a portion of the common electrode 32 facing the pressure chamber 26, and one of the individual electrodes 34 corresponding to the pressure chamber 26. In other words, the common electrode 32 and the piezoelectric body 33 are shared by a plurality of piezoelectric elements 31, while the piezoelectric elements 31 are individualized (made independent from one another) by the individual electrodes 34, respectively. Note that a portion, of the piezoelectric body 33, which is sandwiched between the common electrode 32 and each of the individual electrodes 34 is hereinafter referred to as an "active portion 36".

In such a manner, the individual electrodes 34 are arranged in one-to-one relationship with respect to the pressure chambers 26. The piezoelectric elements 31 construct piezoelectric element rows 37 in a similar manner as the nozzles 24 and the pressure chambers 26 construct the nozzle rows 28*k*1, 28*k*2, 28*y*1, 28*y*2 and the pressure chamber rows 29*k*1, 29*k*2, 29*y*1, 29*y*2, respectively, in a predetermined positional relationship. In one piece of the head units 16, two piezoelectric element rows 37 correspond to each one color ink among the two color inks, and the total of four piezoelectric element rows 37*k*1, 37*k*2, 37*y*1 and 37*y*2 are constructed.

Further, as described above, the individual electrode 34*b* of each of the piezoelectric elements 31*b* in the piezoelectric element row 37*y*2 on the right (rightmost) end has a shape which is more elongated in the scanning direction as compared with the individual electrode 34*a* of each of the piezoelectric elements 31*a* in the remaining other piezoelectric element rows 37. An active portion 36*b* of each of the piezoelectric elements 31*b* also has a width in the conveyance direction which is shorter than a width in the conveyance direction of an active portion 36*a* of each of the piezoelectric elements 31*a* of in remaining other piezoelectric element rows 37, and has a length in the scanning direction which is longer than a length in the scanning direction of the active portion 36*a* of each of the piezoelectric elements 31*a* of the remaining other piezoelectric element rows 37. With this, in the piezoelectric element row 37*y*2, a width A2 (see FIG. 5) of a space (gap) between two active portions 36*b* which are adjacent in the conveyance direction is greater than a width of a space between two active portions 36*a* which are adjacent in the conveyance direction in the remaining other piezoelectric element rows 37.

Note that in the following explanation, the piezoelectric element 31*a* is referred to as a "first piezoelectric element 31*a*", the piezoelectric element 31*b* is referred to as a "second piezoelectric element 31*b*", the active portion 36*a* of the first piezoelectric element 31*a* is referred to as a "first active portion 36*a*", and the active portion 36*b* of the second piezoelectric element 31*b* is referred to as "second active portions 36*b*".

Further, a portion, of the piezoelectric body 33*a*, covering each of the first pressure chambers 26*a* corresponds to a "first piezoelectric portion" of the present teaching; and a portion, of the piezoelectric body 33*b*, covering each of the second pressure chambers 26*b* corresponds to a "second piezoelectric portion" of the present teaching. The individual electrode 34*a* and a portion of the common electrode 32 which sandwich the first piezoelectric portion of the piezoelectric body 33*a* therebetween correspond to a "first electrode pair" of the present teaching; and the individual electrode 34*b* and a portion of the common electrode 32 which sandwich the second piezoelectric portion of the piezoelectric body 33*b* therebetween correspond to a "second electrode pair" of the present teaching.

In each of the above-described piezoelectric elements 31, when an electric field acts between the common electrode 32 and the individual electrode 34, the active portion 36 is deformed in a planar direction of the piezoelectric element 31. Although the vibration film 30 is not deformed by the electric field, the vibration film 30 is deformed (undergoes the unimorph deformation), together with one piece of the piezoelectric elements 31, in a direction orthogonal to the plane thereof. Namely, each of the piezoelectric elements 31 constructs one piece of the actuator together with the vibration film 30, and changes the volume of one of the pressure chambers 26. The piezoelectric actuator 22 includes such individual actuators of which number corresponds to the number of the pressure chambers 26.

Further, as depicted in FIG. 4, the piezoelectric actuator 22 includes the protective film 40, the insulating film 41, wires 42 and the wire protecting film 43, in addition to the above-described plurality of piezoelectric elements 31.

As depicted in FIG. 4, the protective film 40 is arranged on the upper surface of the vibration film 30 so as to cover the four piezoelectric bodies 33. The protective film 40 prevents moisture in the air from reaching the piezoelectric bodies 33. The protective film 40 can be formed, for example, of a material having a low water permeability such as oxides including alumina ($Al_2O_3$), silicon oxide (SiOx), tantallum oxide (TaOx), etc., or nitrides including silicon nitride (SiN), etc. Note that as depicted in FIGS. 4 and 5, the protective film 40 is arranged regarding the individual electrodes 34 such that the protective film 40 covers only a circumferential portion of each of the individual electrodes 34, and that a central portion of each of the individual electrodes 34 is exposed from the protective film 40. Namely, since the protective film 40 hardly overlaps with the active portions 36 of the piezoelectric bodies 33, the protective film 40 does not hinder or inhibit the deformation of the active portions 36.

The insulating film 41 is formed on the protective film 40. The insulating film 41 is arranged below the wires 42 (to be described next) to insulate the wires 42 from the common electrode 32. The insulating film 41 is formed at regions between the four pressure chamber rows 29 arranged side by side in the scanning direction, and at regions between the pressure chambers 26. On the other hand, at regions in each of which one of the pressure chambers 26 (piezoelectric elements 31) is arranged, the insulating film 41 covers only a right end portion of the individual electrode 34, as depicted in FIG. 4, and the majority of portions of the piezoelectric element 31 is exposed from the insulating film 41. Note that although the material forming the insulating film 41 is not particularly limited, the insulating film 41 is formed, for example, of silicon dioxide ($SiO_2$).

The plurality of wires 42 are formed on the insulating film 41. The wires 42 are formed of a material having a low electric resistivity such as aluminum (Al), gold (Au), or the like. Each of the wires 42 has an end portion disposed on a portion, of the insulating film 41, overlapping with one of the individual electrodes 34, and extends in the scanning direction. At each of regions overlapping with the individual electrodes 41 respectively, a through hole penetrates through the protective film 40 and the insulating film 41. Each of the wires 42 is connected to one of the individual electrodes 34 via the through hole.

Each of the wires 42 is extended rightward from the individual electrode 34 of one of the piezoelectric elements 31. Regarding a certain piezoelectric element row 37, which is included in the four piezoelectric element rows 37 and which has another or other piezoelectric element row or rows 37 located on the right side of the certain piezoelectric element row 37 in the scanning direction, the wires 42 extended from the certain piezoelectric element row 37 pass through or traverse the another or other piezoelectric element row or rows 37. In a case that there is not any piezoelectric element row 37 located on the right side of the certain piezoelectric element row 37, the wires 42 extended from the certain piezoelectric element row 37 reach directly the right end portion of the channel substrate 21. For example, since the piezoelectric element row **37*y*1 has the piezoelectric element row 37*y*2 located on the right side thereof, the wires 42 extended from the piezoelectric element raw 37*y*1 pass between the piezoelectric elements 31 of the piezoelectric element row 37*y*2 and extend up to the right end portion of the channel substrate 21**.

A plurality of drive contact sections (drive contact point sections) 46 and two ground contact sections (ground contact point sections) 47 are arranged on the upper surface of the channel substrate 21, at the right end portion thereof. As depicted in FIG. 3, the respective contact sections 46 and 47 are arranged to form a row, with the right end portions thereof aligned. The both end portions of the aligned contact sections are the ground contact sections 47. Each of the drive contact sections 46 is connected to one of the wires 42, and the ground contact sections 47 are connected, respectively via through holes, to the common electrode 32 which is disposed immediately below the ground contact sections 47. These through holes have a same shape and same size to those of the through holes via which the wires 42 are connected to the individual electrodes 34, and penetrate through the protective film 40 and the insulating film 41.

As depicted in FIGS. 2 and 3, each of the ink supply holes **30*a* of the vibration film 30 is surrounded by a conductive body (conductive portion 44 or 45). Since each of the conductive portions 44 and 45 is circular-shaped, the water-tightness with respect to the ink supply holes 30*a* is enhanced in a case that the reservoir-forming member 23 is joined to the channel substrate 21, as will be described later on. Note that the conductive portions 44 surrounding the ink supply holes 30*a* of the three pressure chamber rows 29*k*1, 29*y*1 and 29*y*2 are connected to the driving contact sections 46 via the wires 42, respectively. On the other hand, the conductive portions 45 surrounding the ink supply holes 30*a* of the pressure chamber row 29*k*2** are arranged independently.

As depicted in FIG. 4, the wire protecting film 43 covers the plurality of wires 42 from thereabove. By the wire protecting film 43, any corrosion of the wires 42 is prevented, and the insulating property among the plurality of wires 42 is enhanced. Note that the drive contact sections 46 and the ground contact sections 47 are exposed from the wire protecting film 43. The exposed contact sections 46 and 47 are capable of being connected to a COF 50 (to be described later on). The wire protecting film 43 is formed, for example, of silicon nitride (SiNx), etc.

As depicted in FIGS. 2 and 3, an end portion of a COF 50 is joined to the right end portion of the channel substrate 21. A driver IC 51 is mounted on an intermediate portion of the COF 50. Further, the other end portion of the COF 50 is connected to the controller 7 (see FIG. 1) of the printer 1. The COF 50 is formed with a plurality of driving wires 52 (see FIG. 4) and a ground wire (omitted in the drawings). Each of the driving wires 52 is connected to an output terminal of the driver IC 51. The plurality of driving wires 52 are communicated with the plurality of drive contact sections 46, respectively, and the ground wires are communicated with the ground contact sections 47.

The driver IC 51 generates a drive signal based on a control signal from the controller 7, and outputs the generated drive signal to each of the piezoelectric elements 31. The drive signal is input to each of the drive contact sections 46 via one of the driving wires 52; further, the drive signal is supplied from each of the drive contact sections 46 to one of the individual electrodes 34 corresponding thereto via one of the wires 42. When the ink(s) is (are) to be discharged, the potential of the individual electrode 34 is changed between a predetermined driving potential and the ground potential. The potential of the common electrode 32 is always maintained at the ground potential.

The action of each of the piezoelectric elements 31 when the drive signal is supplied from the driver IC 51 to each of the piezoelectric elements 31 will be explained. In a state that the drive signal is not supplied, the potential of the individual electrode 34 is the ground potential that is same as the potential of the common electrode 32. From this state, when the drive signal is supplied to the individual electrode 34 of certain one of the piezoelectric elements 31, an electric field parallel in the thickness direction of the piezoelectric portion 36 of the piezoelectric body 33 acts on the piezoelectric portion 36 due to a potential difference between the individual electrode 34 and the common electrode 32 disposed to face the individual electrode 34. In this situation, the active portion 36 elongates or expands in the thickness direction and contracts (is compressed) in a planar direction of the active portion 36. By the combination of the vibration film 30 and the active portion 36 (piezoelectric element 31), this certain individual actuator is bent or curved so as to project toward a pressure chamber 26 corresponding thereto. With this, the volume of the pressure chamber 26 is reduced, which in turn generates a pressure wave inside the pressure chamber 26, thereby causing a nozzle 24 communicating with the pressure chamber 26 to discharge a liquid droplet of the ink.

<Reservoir Forming Member>

As depicted in FIGS. 2 to 4, the reservoir forming member 23 is adhered to the upper surface of the channel substrate 21 in which the piezoelectric actuator 22 is formed, with a thermosetting (heat-hardening) adhesive.

As depicted in FIG. 4, two reservoirs 60 arranged side by side in the scanning direction are formed in an upper portion of the reservoir forming member 23. The two color inks, which are the black and yellow inks, are supplied to the two reservoirs 60 from two ink cartridges 15 (see FIG. 1), respectively, of the holder 5. Four recessed portions 63 are formed in a lower portion of the reservoir forming member 23, corresponding to the four piezoelectric bodies 33, respectively. Further, wall portions 64 defining the four recessed portions 63 are formed with a plurality of ink supply channels 65 communicating with the reservoirs 60.

In a case that the reservoir forming member 23 is adhered to the upper surface of the channel substrate 21, the four piezoelectric bodies 33 are accommodated in the four recessed portions 63, respectively. In this situation, the plurality of ink supply channels 65 are connected to the plurality of ink supply holes 30*a*, respectively, formed in the vibration film 30. With this, the ink inside each of the reservoirs 60 is supplied to the pressure chambers 26 respectively via the ink supply channels 65 and the ink supply holes 30*a*.

<Relationship Between the Shapes of Pressure Chambers and Piezoelectric Elements and the Wires>

As described above, the wires 42 are drawn rightward from the piezoelectric elements 31 (the individual electrodes 42), respectively. As depicted in FIGS. 2 and 3, the wires 42 drawn from each of the piezoelectric element rows 37*k*1, 37*k*2 and 37*y*1 pass between the piezoelectric elements 31 belonging to the piezoelectric element row or rows 37 located on the right side of each of the piezoelectric element rows 37*k*1, 37*k*2 and 37*y*1, and are extended up to the drive contact sections 46 at the right end portion of the channel substrate 21.

Accordingly, as a certain piezoelectric element row 37, among the four piezoelectric element rows 37, is located closer to the drawing or extracting side to which the wires 42 are drawn, the number of the wires 42 (drawn from another piezoelectric element row 37 or other piezoelectric element rows 37) passing through the piezoelectric elements 31 belonging to the certain piezoelectric element row 37, becomes greater. Specifically, the number of such wires 42 is 0 (zero) in the piezoelectric element row 37*k*1 located at the left (leftmost) end; whereas the number of such wires 42 is 1 (one) in the piezoelectric element row 37*k*2, the number of such wires 42 is 2 (two) in the piezoelectric element row 37*y*1, and the number of such wires 42 is 3 (three) in the piezoelectric element row 37*y*2 located at the right (rightmost) end.

However, the miniaturization of the head unit 16 and the high density arrangement of the nozzles 24 make it difficult to arrange the wire(s) 42 between two adjacent piezoelectric elements 31, as the alignment pitch for the pressure chambers 26 and the piezoelectric elements 31 (individual electrodes 34) becomes smaller (finer). Note that although it is conceivable to reduce an arrangement spacing distance (interval) Px between the wires 42 to thereby arrange the plurality of wires 42 between two piezoelectric elements 31, there is such a case that the spacing distance Px cannot be made small as desired, due to the restrictions such as the wiring resistance, the wiring forming method, etc.

In the present embodiment, the piezoelectric actuator 22 is formed with the semiconductor process in which the formation of various thin films and the patterning therefor are repeatedly performed on the upper surface of the channel substrate 21. Here, in a case of using a general aligner so as to expose a resist when forming the wires by means of the photolithographic method, the spacing distance Px between the wires 42 becomes 4.0 μm. It is possible to make the spacing distance Px to be narrower (for example, 1.0 μm) by using a stepper rather than using the aligner. Note that, however, while the aligner is capable of performing full-field exposure of the wafer, the stepper is configured to expose the wafer locally at a high exposure precision, but with a high cost for processing per one chip.

On the other hand, in a case that the nozzle alignment pitch P in one nozzle row 28 is made small for the purpose of realizing a high resolution, the distance between the adjacent pressure chambers 26 and/or the distance between the adjacent piezoelectric elements 31 become/becomes smaller. For example, in a case that the resolution in one nozzle row 28 is 300 dpi, the nozzle alignment pitch P (alignment spacing distance between the pressure chambers 26) is 84 μm. In this case, the width A1 in the space between the pressure chambers 26 is about 14 μm. It is difficult to arrange, in this narrow region, three pieces of the wires 42 of which width is, for example, 3 μm at the alignment spacing distance Px (in a range of 4.0 μm to 10.0 μm).

In view of the above point, in the present embodiment, the width Wb in the conveyance direction (alignment direction) of the second active portions 36*b* (individual electrodes 34*b*) of the piezoelectric elements 31*b* located at the right end is made to be shorter than the width Wa in the conveyance direction (alignment direction) of the first active portions 36*a* (individual electrodes 34*a*) of the piezoelectric elements 31*a* different from the piezoelectric elements 31*b*. With this, the width A2 of the region (space) between the adjacent second active portions 36*b* is widened, which in turn makes it easier to arrange the plurality of wires 42 between the second piezoelectric elements 31*b*. Specifically, even in a case that the alignment spacing distance Px of the wires 42 is in a range of 4.0 μm to 10.0 μm, it is possible to arrange three pieces of the wire 42 between the two second piezoelectric elements 31*b*. Accordingly, as depicted in FIG. 2, a configuration is possible wherein the four nozzle rows 28 each having the resolution of 300 dpi are arranged, while allowing the wires 42 to be drawn rightward from all of the piezoelectric elements 31 of the four piezoelectric element rows 37.

Further, in the present embodiment, as the number of the pressure chamber rows 29 is greater on the left side relative to the pressure chamber row 29*y*2 on the right end, the number of the wires 42 passing through the piezoelectric elements 31 becomes greater in the piezoelectric element row 37*y*2. Namely, the above-described configuration is suitable to a case with a great number of the piezoelectric element rows 37, since the width of the piezoelectric elements 31 on the right end is smaller than the width of the other piezoelectric elements 31 which are different from the piezoelectric elements 31 on the right end.

On the other hand, in a case that the width of the active portions 36 of the piezoelectric elements 31 becomes small, the discharging characteristic of the nozzles 24 is lowered; the deformation amount of the active portions 36 becomes small, the ink discharge amount is decreased, and/or the ink discharging speed is lowered. In view of these points, in the present embodiment, the length Lb in the scanning direction of the second active portion 36*b* is longer than the length La in the scanning direction of the first active portion 36*a*. With this, any reduction in the deformation amount of the active portions 36 is supplemented (compensated), and any difference in the characteristic between the first and second active portions 36*a* and 36*b* can be made small.

Further, the width in the conveyance direction (the short direction of the pressure chamber 26) of the active portion 36 affects the displacement amount to an extent greater than the length in the scanning direction (the longitudinal direction of the pressure chamber 26) of the active portion 36. In a case of adjusting the discharging characteristic, any difference in the characteristic occurs between the first and second active portions 36*a* and 36*b* even if the areas of the first and second active portions 36*a* and 36*b* were made to be same with each other. In view of this, it is possible to increase the length Lb of the second active portion 36*b* to be further longer such that the area of the second active portion 36*b* is greater than the area of the first active portion 36*a* as viewed in the up/down direction (the third direction in the present teaching), in order to make any difference in the characteristic between the first and second active portions 36*a* and 36*b* to be small.

Furthermore, in the present teaching, the shape of the second pressure chambers 26*b* on the right end is made different from the shape of the first pressure chambers 26*a* on the left side relative to the second pressure chamber 26*b*, in a similar manner by which the shape of the second active portion 36*b* is made different from the shape of the first active portion 36*a*. Namely, the width W2 in the conveyance direction of the second pressure chamber 26*b* is shorter than the width W1 in the conveyance direction of the first pressure chamber 26*a*; and the length L2 in the scanning direction of the second pressure chamber 26*b* is longer than the length L1 in the scanning direction of the first pressure chamber 26*a*. With this, it is possible to widen the spacing distance in the conveyance direction (the width of the region A1) between the adjacent two second pressure chambers 26*b* in the pressure chamber row 29*y*2 on the right end.

In addition to the above-described configuration, each of the wires 42*a*, drawn from the piezoelectric element rows 37*k*1, 37*k*2 and 37*y*1 as the three piezoelectric element rows 37 located on the left side relative to the piezoelectric element row 37*y*2 located at the right end, is arranged between the two second piezoelectric elements 31*b* in the piezoelectric element row 37*y*2 located at the right end, only in a region not overlapping with any one of the second pressure chambers 26*b*, as depicted in FIG. 5. Accordingly, the deformation of the vibration plate 30 is not hindered or inhibited by the wires 42*a*.

Moreover, the wire protecting film 43 covering the wires 42*a* is also arranged only in the region not overlapping with any one of the second pressure chambers 26*b*. Accordingly, the deformation of the vibration plate 30 is not hindered by the wire protecting film 43.

Next, an explanation will be given about modifications in which various changes are made to the above-described embodiment. Note that, however, any parts or components constructed in the similar manner to that in the above-described embodiment are designated with same reference numerals, and description thereof is omitted as appropriate.

In the above-described embodiment, the shape and the size are made different between the piezoelectric element rows 37*y*1 and 37*y*2 for the yellow ink. In this case, although the size and shape are made different between the piezoelectric element rows 37*y*1 and 37*y*2 such that the difference in the discharging characteristic (such as the ink discharge amount, the ink discharging speed, etc.) is made to be small as much as possible, there is such a fear that the adjustment in the size and/or shape might be insufficient to some extent. Accordingly, there is such a concern that the image quality of an image regarding the yellow ink might be lowered.

Figure 6:
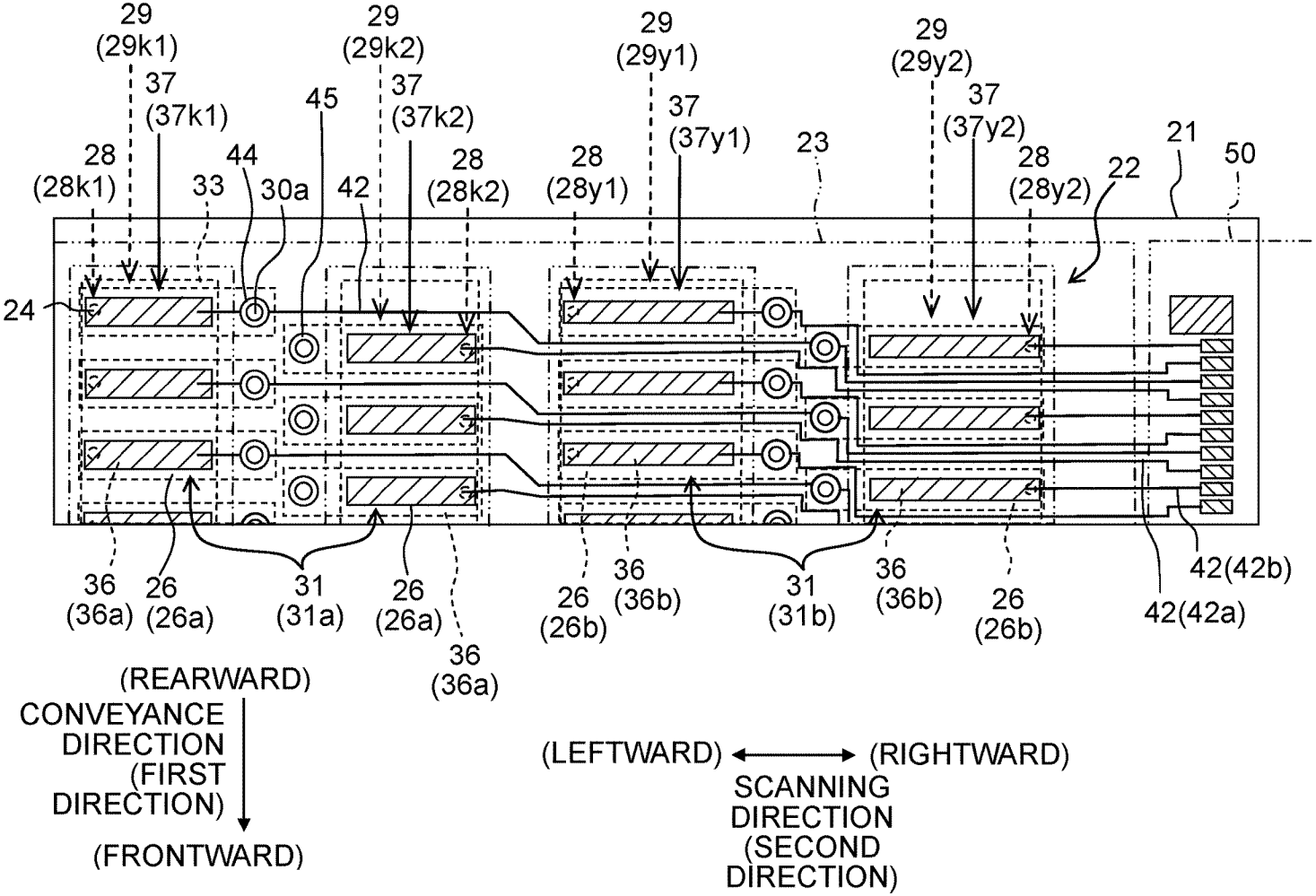
FIG. 6 is an enlarged view of a modification, corresponding to FIG. 3.

In view of this, as depicted in FIG. 6, active portions 36 having a same size and a same shape are adopted for the yellow ink, and another active portions 36 having a different size and a different shape from the active portions 36 for the yellow ink are adopted for an ink of which color is different from the yellow ink. Specifically, a combination of the first active portion 36*a* and the first pressure chamber 26*a* is adopted as the source from which the black ink is supplied; and a combination of the second active portion 36*b* and the second pressure chamber 26*b* is adopted as the source from which the yellow ink is supplied. Note that in this modification, the black ink corresponds to the "first liquid" of the present teaching, and the yellow ink corresponds to the "second liquid" of the present teaching.

With respect to the other color inks (for example, the magenta ink, the cyan ink, etc.), the combination of the first active portion 36*a* and the first pressure chamber 26*a* is adopted, as well. Only the yellow ink, of which chromaticness is low, is combined with the second active portion 36*b* and the second pressure chamber 26*b*. In this situation, although the difference in the size and shape of the active portions 36 between the yellow ink and the other ink(s) different from the yellow ink appear as any difference in dot size of image, any shift in the landing position of inks, etc. in some cases, the low chromaticness of the yellow ink makes such an influence due to the difference in the size and shape of the active portions 36 to be less conspicuous.

Further, regarding the pressure chamber rows 29*y*1 and 29*y*2 for the yellow ink, the relationship between the size and shape thereof and the discharging characteristic thereof can be explained in a similar manner as regarding the active portions 36 described above. From the viewpoint of suppressing the difference in discharging characteristic to be small, the pressure chamber rows 29*y*1 and 29*y*2 to which the same ink is supplied preferably have pressure chambers 26 with a same size and a same shape, as depicted in FIG. 6. The same can be said also regarding the influence brought about the chromaticness, and thus the second pressure chambers 26*b* are combined with the pressure chamber rows 29*y*1 and 29*y*2 for the yellow ink, and the first pressure chambers 26*a* are combined with the pressure chamber rows 29 for the inks of which colors are different from the yellow ink (including the black ink). In this case also, the low chromaticness of the yellow ink makes such an influence brought about the difference in the discharging characteristic to be less conspicuous.

As appreciated from FIG. 3 of the above-described embodiment, as a piezoelectric element 37 row included in the four piezoelectric element rows 37 is located closer to the right side (the side to which the wires are drawn), the number of the wires 42 arranged between the adjacent piezoelectric elements 31 becomes greater. In view of this, as a piezoelectric element row 37 included in the four piezoelectric element rows 37 is located closer to the right side, the piezoelectric element row 37 may have active portions 36, of the piezoelectric elements 31, of which width in the conveyance direction is smaller and of which length in the scanning direction is longer.

In the above-described embodiment, the second pressure chambers 26*b* are formed to have an elongated shape similarly to the second active portions 36*b* (individual electrodes 34*b*). It is allowable, however, that the second pressure chambers 26*b* have a same shape as that of the first pressure chambers 26*a*. Namely, it is allowable that the pressure chambers 26 all have a same shape, and only a part of the active portions 36 has a different shape from the remaining of the active portions 36.

Figure 7:
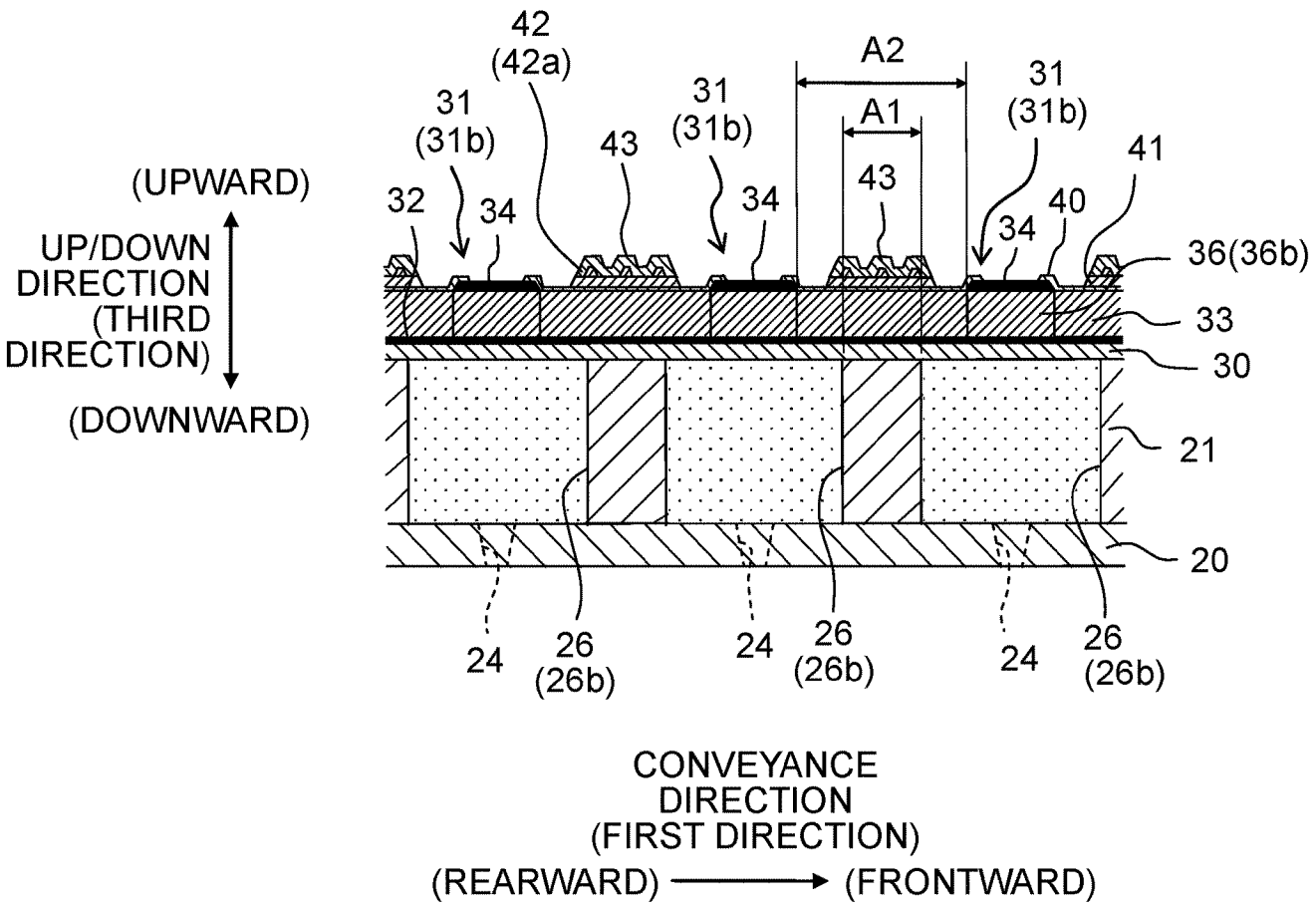
FIG. 7 is an enlarged view of another modification, corresponding to FIG. 5.

Note that in such a case, as depicted in FIG. 7, although the width A2 of the region between the second active portions 36*b* is greater by forming the second active portions 36 to have an elongated shape, the width A1 of the region between the second pressure chambers 26*b* is not widen, unlike in the above-described embodiment depicted in FIG. 5. Accordingly, there can be such a case that a portion or part of the wires 42*a* and/or a portion of the wire protecting film 43 are/is arranged in a region overlapping with the second pressure chamber(s) 26*b*. Even in such a case, however, the wires 42*a* and/or the wire protecting film 43 do/does not overlap with the second active portion(s) 36*b*, and thus any hindrance to the deformation of the second active portion(s) 36*b* can be suppressed.

In the above-described embodiment, the wire protecting film 43 is disposed so as to cover the wires 42. It is allowable, however, to omit the wire protecting film 43 depending on the material forming the wires 42, for example, in such a case that the wires 42 are formed of gold (Au).

The number of the nozzle rows 28 (of the pressure chamber rows 29, the piezoelectric element rows 37) is not limited to four (4). Note that as the number of the nozzle rows 28 (of the piezoelectric element rows 37) is greater, the number of wires 42 passing between the adjacent piezoelectric elements 31 becomes greater in a certain piezoelectric element row 37, among the plurality of piezoelectric element rows 37, which is located at the end on the side to which the wires 42 are drawn. Namely, as the number of the nozzle rows 28 is greater as in the present teaching, the region between the active portions 36 of the two adjacent piezoelectric elements 31 can be widened as in the present teaching.

The embodiment and the modifications thereof as described above are aspects in each of which the present teaching is applied to the ink-jet head configured to print an image, etc. on a recording paper by discharging the ink(s) onto the recording paper, as an example of the liquid discharging apparatus. However, the present teaching is also applicable to liquid discharging apparatuses usable for various kinds of applications other than the printing of image, etc. For example, the present teaching is applicable also to a liquid discharging apparatus for industrial use which forms a conductive pattern on a surface of a substrate by discharging a conductive liquid onto the substrate.

What is claimed is:

1. A liquid discharging apparatus comprising:

a first nozzle;

two second nozzles arranged side by side in a first direction;

a substrate defining a first pressure chamber, and two second pressure chambers arranged side by side in a first direction, wherein the two second pressure chambers are positioned next to the first pressure chamber in a second direction crossing the first direction;

a vibration film covering the first pressure chamber and the two second pressure chambers;

a first piezoelectric element which is arranged on the vibration film corresponding to the first pressure chamber and which includes a first piezoelectric portion overlapping with the first pressure chamber, and a first electrode pair constructed of two electrodes sandwiching the first piezoelectric portion in a third direction orthogonal to the first and second directions;

two second piezoelectric elements which are arranged side by side on the vibration film corresponding to the two second pressure chambers, respectively, and each of which includes a second piezoelectric portion overlapping with one of the two second pressure chambers, and a second electrode pair constructed of two electrodes sandwiching the second piezoelectric portion in the third direction;

a first wire connected to the first piezoelectric element;

two second wires connected to the two second piezoelectric elements, respectively; and three contact sections connected to the first wire and the two second wires, respectively, wherein the two second pressure chambers are positioned between the first pressure chamber and the three contact sections in the second direction, wherein the first wire passes between the two second piezoelectric elements and extends toward a contact section, among the three contact sections, corresponding thereto, and wherein a length in the first direction of a second active portion, which is included in the second piezoelectric portion of each of the two second piezoelectric elements and which is sandwiched between the second electrode pair, is shorter than a length in the first direction of a first active portion which is included in the first piezoelectric portion of the first piezoelectric element and which is sandwiched between the first electrode pair.

2. The liquid discharging apparatus according to claim 1, wherein the first pressure chamber is included as part of a plurality of first pressure chambers; and the plurality of first pressure chambers form a plurality of first pressure chamber-rows each of which is aligned in the first direction and which are arranged side by side in the second direction.

3. The liquid discharging apparatus according to claim 2, wherein the first wire is included as part of a plurality of first wires, and wherein an arrangement distance in the first direction by which each of the plurality of first wires is arranged between the two second piezoelectric elements is within a range of 4.0 μm to 10.0 μm.

4. The liquid discharging apparatus according to claim 1, wherein the first pressure chamber and the two second pressure chambers each have a shape in which a length in the second direction is longer than a length in the first direction, and wherein an area of the second active portion, as seen in the third direction, is greater than an area of the first active portion, as seen in the third direction.

5. The liquid discharging apparatus according to claim 1, wherein a length in the first direction of each of the two second pressure chambers is shorter than a length in the first direction of the first pressure chamber, and wherein a length in the second direction of each of the two second pressure chambers is longer than a length in the second direction of the first pressure chamber.

6. The liquid discharging apparatus according to claim 5, wherein the first wire is arranged, between the two second piezoelectric elements, only in a region not overlapping with any of the two second pressure chambers.

7. The liquid discharging apparatus according to claim 6, further comprising a wire protecting film covering the first wire, wherein the wire protecting film is arranged, between the two second piezoelectric elements, only in the region not overlapping with any of the two second pressure chambers.

8. The liquid discharging apparatus according to claim 1, wherein a first liquid is supplied to the first pressure chamber and a second liquid different from the first liquid is supplied to the two second pressure chambers.

9. The liquid discharging apparatus according to claim 8, wherein the two second pressure chambers are included in a plurality of second pressure chamber-rows each of which is aligned in the first direction and which are arranged side by side in the second direction, and wherein all pressure chambers included in the plurality of second pressure chamber-rows have a same shape.

10. A liquid discharging apparatus comprising:

a substrate defining a first pressure chamber and two second pressure chambers arranged side by side in a first direction, wherein the two second pressure chambers are positioned next to the first pressure chamber in a second direction crossing the first direction;

a vibration film covering the first pressure chamber and the two second pressure chambers;

a first piezoelectric element which is arranged on the vibration film and corresponding to the first pressure chamber;

two second piezoelectric elements arranged on the vibration film and corresponding to the two second pressure chambers, respectively;

a first wire connected to the first piezoelectric element;

two second wires connected to the two second piezoelectric elements, respectively; and three contact sections connected to the first wire and the two second wires, respectively, wherein the two second pressure chambers are positioned between the first pressure chamber and the three contact sections in the second direction, wherein the first wire passes between the two second piezoelectric elements and extends toward a contact section, among the three contact sections, corresponding thereto, and wherein a length in the first direction of each of the two second pressure chambers is shorter than a length in the first direction of the first pressure chamber.

11. The liquid discharging apparatus according to claim 10, wherein a length in the second direction of each of the two second pressure chambers is longer than a length in the second direction of the first pressure chamber.

12. The liquid discharging apparatus according to claim 10, wherein the first wire passes between the two second pressure chambers and extends toward a contact section, among the three contact sections, corresponding thereto.

* * * * *